US010941961B2

(12) United States Patent
Mislak

(10) Patent No.: US 10,941,961 B2
(45) Date of Patent: Mar. 9, 2021

(54) ULTRASONIC CONDENSATE MANAGEMENT SYSTEM AND METHOD

(71) Applicant: Johnson Controls Technology Company, Auburn Hills, MI (US)

(72) Inventor: Nicholas P. Mislak, Bel Air, MD (US)

(73) Assignee: Johnson Controls Technology Company, Auburn Hills, MI (US)

( * ) Notice: Subject to any disclaimer, the term of this patent is extended or adjusted under 35 U.S.C. 154(b) by 170 days.

(21) Appl. No.: 15/994,879

(22) Filed: May 31, 2018

(65) Prior Publication Data

US 2019/0360721 A1 Nov. 28, 2019

Related U.S. Application Data

(60) Provisional application No. 62/675,034, filed on May 22, 2018.

(51) Int. Cl.
*F24F 13/22* (2006.01)
*F24F 6/12* (2006.01)

(52) U.S. Cl.
CPC ..... *F24F 13/222* (2013.01); *F24F 6/12* (2013.01); *F24F 2013/227* (2013.01); *F24F 2013/228* (2013.01)

(58) Field of Classification Search
CPC ..... F24F 6/12; F24F 13/222; F24F 2013/227; F24F 2013/228; F24F 3/1417
See application file for complete search history.

(56) References Cited

U.S. PATENT DOCUMENTS

| | | | | |
|---|---|---|---|---|
| 3,439,529 | A * | 4/1969 | Patterson | G01N 29/11 73/64.47 |
| 6,112,536 | A * | 9/2000 | Hansen | F25D 21/14 62/285 |
| 6,745,590 | B1 | 6/2004 | Johnson et al. | |
| 9,726,397 | B1 | 8/2017 | Martin et al. | |
| 10,809,006 | B1 * | 10/2020 | Shah | F28B 11/00 |
| 2006/0027487 | A1 * | 2/2006 | Matsuura | C10G 31/00 208/308 |
| 2006/0032935 | A1 * | 2/2006 | Matsuura | B01D 3/006 239/9 |
| 2006/0130506 | A1 * | 6/2006 | Tain | F25B 39/02 62/259.2 |
| 2009/0126385 | A1 * | 5/2009 | Trepte | H05K 7/20818 62/259.2 |
| 2013/0263616 | A1 * | 10/2013 | Pungtrakul | C02F 1/12 62/101 |

(Continued)

FOREIGN PATENT DOCUMENTS

| | | |
|---|---|---|
| CN | 104374016 | 2/2015 |
| WO | 2013164653 | 11/2013 |
| WO | 2016088022 | 6/2016 |

*Primary Examiner* — Kun Kai Ma
(74) *Attorney, Agent, or Firm* — Fletcher Yoder, P.C.

(57) ABSTRACT

A fluid handling system includes an ultrasonic transducer configured to atomize fluid condensate generated by the fluid handling system into atomized fluid particles. The fluid handling system also includes a solid desiccant configured to absorb the atomized fluid particles. The fluid handling system also includes a fluid conduit extending through or against the solid desiccant such that the solid desiccant is configured to cool a heat exchange fluid passing along the fluid conduit.

24 Claims, 7 Drawing Sheets

(56) References Cited

U.S. PATENT DOCUMENTS

| | | | | |
|---|---|---|---|---|
| 2015/0338140 | A1* | 11/2015 | Vandermeulen ..... | F24F 3/1417<br>62/238.3 |
| 2017/0321909 | A1* | 11/2017 | Davies ..... | F24F 3/1429 |
| 2019/0212032 | A1* | 7/2019 | Martinez Galvan .. | F24F 13/222 |

* cited by examiner

ULTRASONIC CONDENSATE MANAGEMENT SYSTEM AND METHOD

CROSS REFERENCE TO RELATED APPLICATIONS

This application claims priority from and the benefit of U.S. Provisional Application Ser. No. 62/675,034, entitled "ULTRASONIC CONDENSATE MANAGEMENT SYSTEM AND METHOD," filed May 22, 2018, which is hereby incorporated by reference in its entirety for all purposes.

BACKGROUND

The present disclosure relates generally to heating, ventilation, and air conditioning (HVAC) systems and, more particularly, to condensate management of the HVAC systems.

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator coil where the fluid absorbs heat and a condenser where the fluid releases heat. The fluid flowing within the closed loop is generally formulated to undergo phase changes within the normal operating temperatures and pressures of the system, so that quantities of heat can be exchanged by virtue of the latent heat of vaporization of the fluid. A fan may blow air over the coils of heat exchanger, such as the evaporator coil, in order to condition the air. In certain embodiments and/or atmospheric conditions, condensate may be formed along the outside of the coil. In traditional embodiments, the condensate may be gravity-fed from the outside of the coil into a drain pan, and may be drained from the drain pan to a surrounding environment.

It is now recognized that traditional condensate handling systems may be susceptible to clogged drains, which may require periodic maintenance. Further, it is now recognized that condensate removed from the HVAC system to environment may be undesirable. Accordingly, improved condensate management systems are desired.

SUMMARY

The present disclosure relates to a fluid handling system. The fluid handling system includes an ultrasonic transducer configured to atomize fluid condensate generated by the fluid handling system into atomized fluid particles. The fluid handling system also includes a solid desiccant configured to absorb the atomized fluid particles. The fluid handling system also includes a fluid conduit extending through or against the solid desiccant such that the solid desiccant is configured to cool a heat exchange fluid passing along the fluid conduit.

The present disclosure also relates to a fluid handling system. The fluid handling system includes a heat exchange coil configured to receive a refrigerant, a drain pan configured to receive fluid condensate formed on an exterior of the heat exchange coil, and an ultrasonic transducer configured to atomize the fluid condensate into atomized fluid particles. The fluid handling system also includes a solid desiccant configured to absorb the atomized fluid particles. Further, the fluid handling system includes a refrigerant conduit fluidly coupled to the heat exchange coil and configured to provide the refrigerant to the heat exchange coil, wherein the refrigerant conduit extends through or against the solid desiccant such that the solid desiccant is configured to cool the refrigerant passing through the refrigerant conduit.

The present disclosure also relates to a fluid handling system having a heating, ventilation, and air conditioning (HVAC) system. The HVAC system includes a heat exchange coil, a refrigerant conduit configured to supply a refrigerant to the heat exchange coil, and a fan configured to urge an air flow over the heat exchange coil as the refrigerant passes through the heat exchange coil. The fluid handling system also includes a fluid condensate management system. The fluid condensate management system comprises an ultrasonic transducer configured to atomize fluid condensate generated on the heat exchange coil into atomized fluid particles. The fluid condensate management system also includes a solid desiccant configured to absorb the atomized fluid particles. The refrigerant conduit of the HVAC system is configured to abut the solid desiccant of the fluid condensate management system such that the solid desiccant is configured to cool the refrigerant passing through the refrigerant conduit.

DRAWINGS

DETAILED DESCRIPTION

Figure 1:
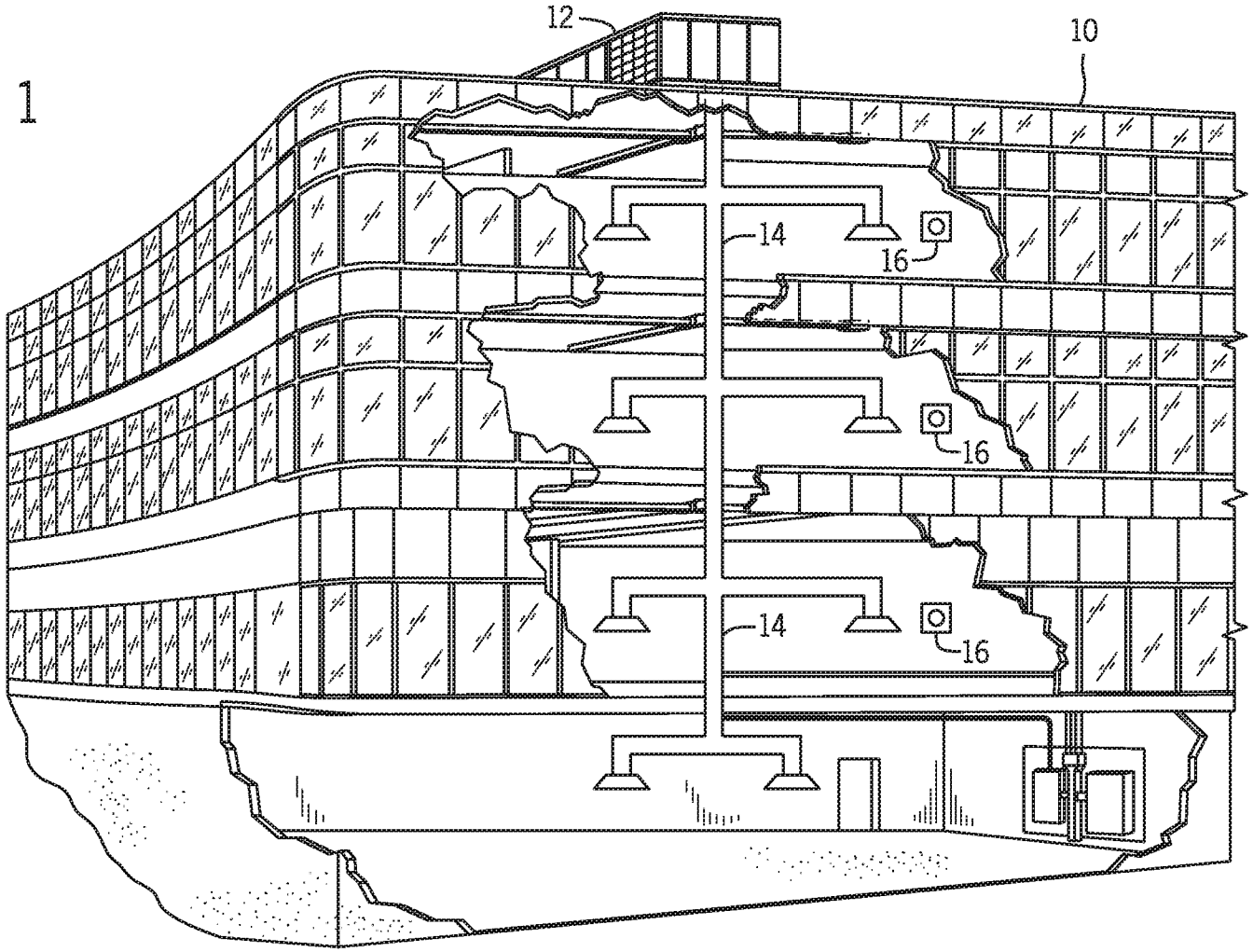
FIG. 1 is a perspective view a heating, ventilation, and air conditioning (HVAC) system for building environmental management, in accordance with embodiments described herein.

The present disclosure is generally directed toward heating, ventilation, and air conditioning (HVAC) systems and, more particularly, toward condensate management of the HVAC system.

For example, HVAC systems may include one or more heat exchange coils, such as an evaporator coil, configured to receive a fluid, such as a refrigerant. The HVAC system may also include a fan which blows air over the heat exchange coil. The fluid flowing within the heat exchange coil may be formulated to undergo phase changes within the normal operating temperatures and pressures of the system, so that quantities of heat can be exchanged by virtue of the latent heat of vaporization of the fluid. The fan of the HVAC system may blow air over the heat exchange coil in order to condition the air. That is, the refrigerant passing through the heat exchange coil may extract heat from the air.

As the air passes over the heat exchange coil, vapor in the air is converted to liquid as the air cools, forming condensate on an exterior of the heat exchange coil. In traditional embodiments, a traditional drain pan may be positioned under the heat exchange coil to receive the condensate, which is gravity-fed into the traditional drain pan, where the condensate may be removed to a surrounding environment via a drain. Depending on the embodiment, the condensate may be drained directly from the traditional drain pan to a surrounding environment, such as a building roof, or the condensate may travel through a traditional drain which carries the condensate to the surrounding environment. Unfortunately, traditional drains for removal of condensate generated by an HVAC system are susceptible to clogging, and may require periodic maintenance. Further, the condensate removed from the HVAC system, for example to the building roof, may include contaminants.

In accordance with present embodiments, condensate is atomized via an ultrasonic transducer, is absorbed by a solid desiccant, and may be utilized to subcool refrigerant upstream of a heat exchange coil. For example, presently disclosed embodiments may include a drain pan configured to receive condensate gravity-fed to the drain pan. An ultrasonic transducer, such as a piezoelectronic transducer, may be positioned in, or proximate to, the drain pan. In some embodiments, the drain pan be modified to act as the ultrasonic transducer. For example, the drain pan may include ultrasonic transducer componentry.

The ultrasonic transducer may be configured to impart acoustic vibration to the condensate, which atomizes fluid particles of the condensate. For example, a piezoelectric ultrasonic transducer may include a material which rapidly expands and contracts when voltage is applied thereto, which causes a diaphragm coupled to the material to vibrate, imparting ultrasonic activity to the condensate. The vibrations may cause capillary waves in the volume of condensate, and when an amplitude of the capillary waves reaches a critical height, droplets, or "atomized fluid particles," may fall off the tips of the waves as the waves are unable to support themselves. The critical height may be correlative to the surface tension of the body of condensate. A solid desiccant may be positioned relative to the ultrasonic transducer and/or drain pan such that the solid desiccant is configured to absorb the atomized fluid particles as the atomized fluid particles separate from the capillary waves. In some embodiments, flow biasing components, such as a fan or fluid conduit, may guide the atomized fluid particles to the solid desiccant. Accordingly, the atomized fluid particles of the condensate are removed from the drain pan, and the atomized fluid particles are absorbed by the solid desiccant.

In addition to the features above, presently disclosed embodiments may include a fluid line, such as a refrigerant line, which provides the refrigerant to the heat exchange coil. In some embodiments, the refrigerant line may be a part of the heat exchange coil. The refrigerant line, sometimes referred to as a refrigerant conduit, may extend through the solid desiccant, or may abut an edge of the solid desiccant. The above-described atomized fluid particles, which are absorbed by the solid desiccant, may lower a temperature of the solid desiccant. Thus, as the refrigerant passes through the refrigerant conduit abutting, or extending through, the solid desiccant, the refrigerant is subcooled by the solid desiccant. By subcooling the refrigerant via the solid desiccant prior to the refrigerant passing through an expansion valve and entering the heat exchange coil, an efficiency of the refrigerant and corresponding heat exchange coil may be improved. These and other features will be described in detail below with reference to the drawings.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
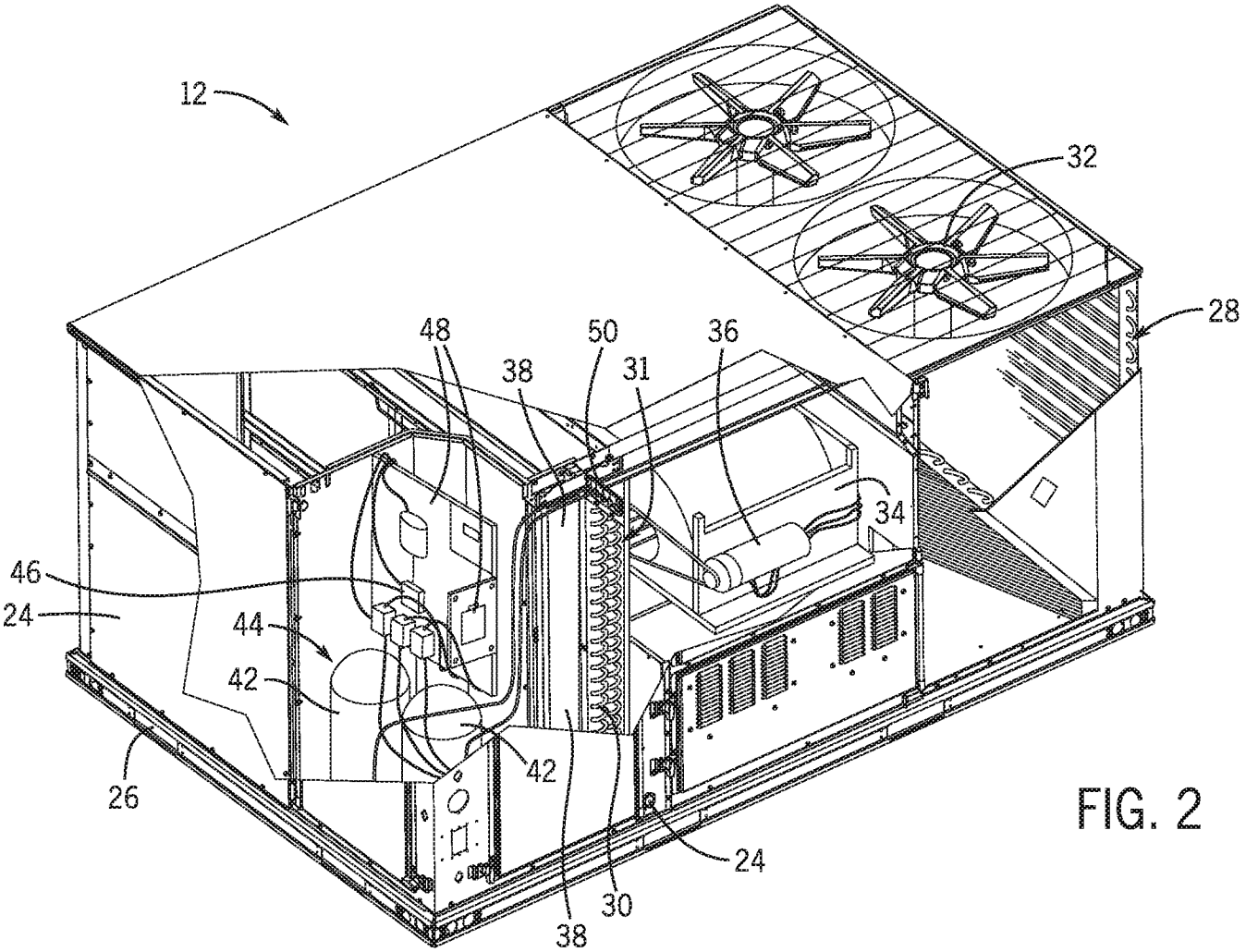
FIG. 2 is a perspective view of the packaged HVAC unit of the HVAC system of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel and/or microchannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
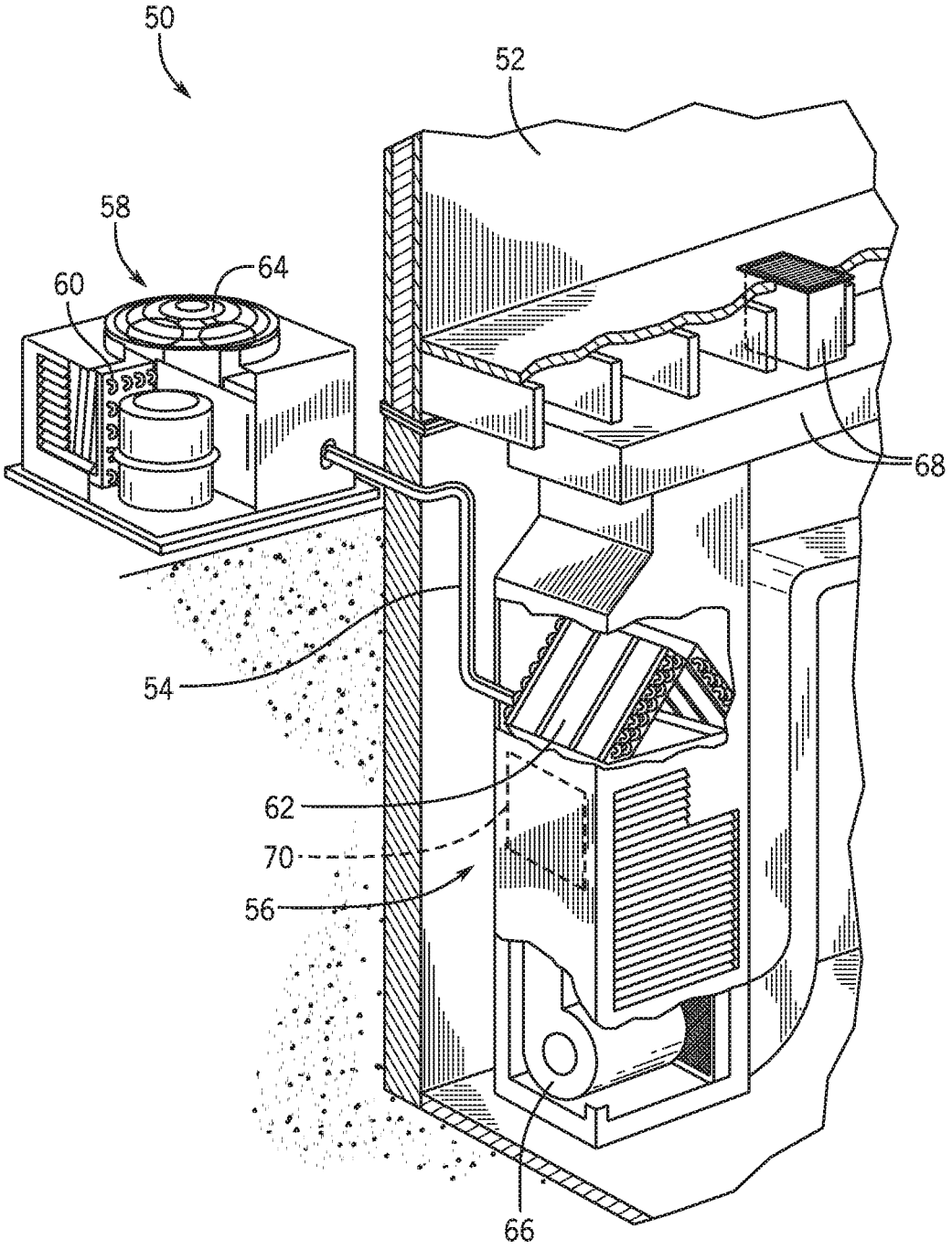
FIG. 3 is a perspective view of a residential HVAC system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
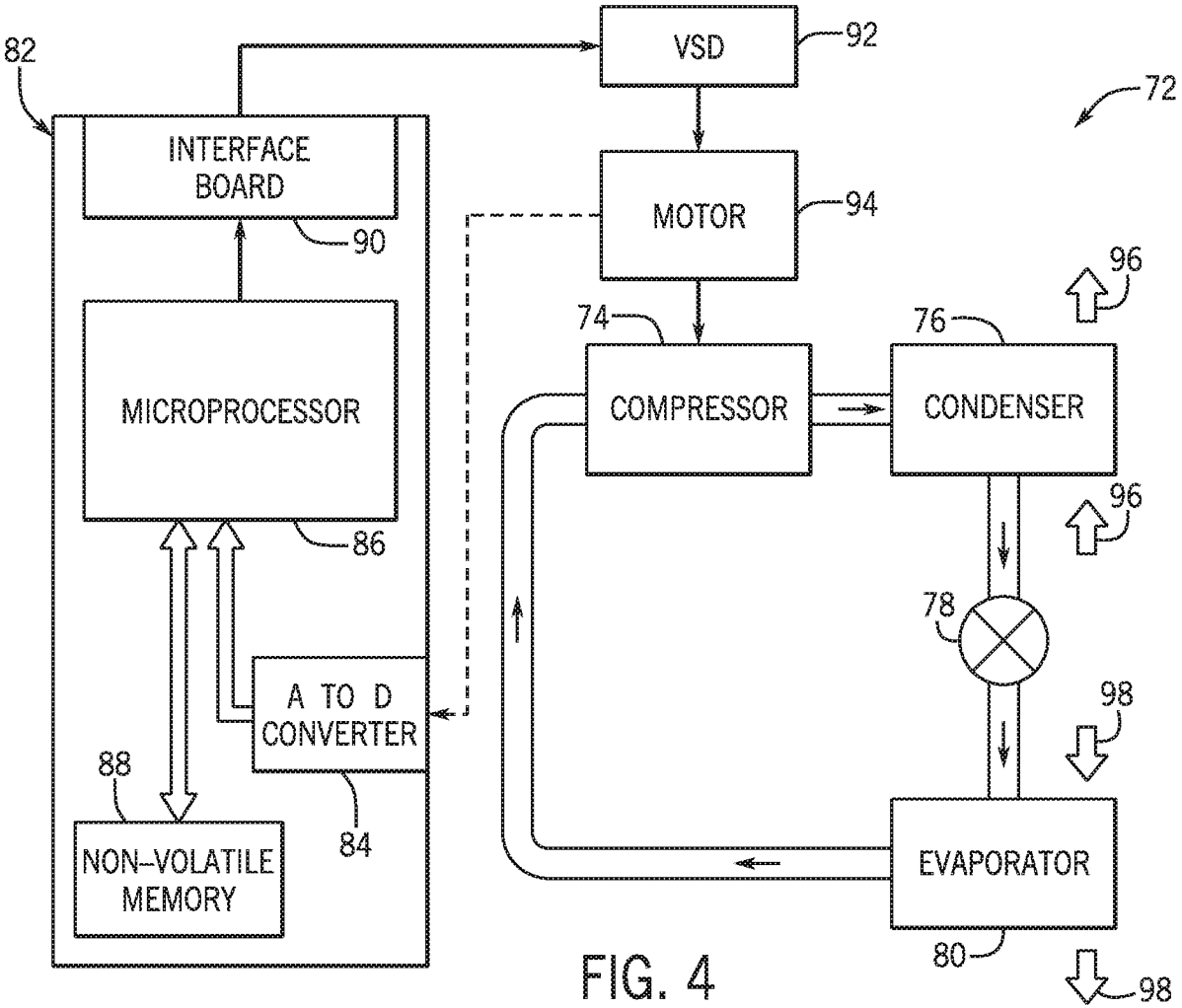
FIG. 4 is a schematic diagram of a vapor compression system that may be used in the packaged HVAC system of FIG. 2 and the residential HVAC system of FIG. 3, in accordance with embodiments described herein.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications. Further, any of FIGS. 1-4 may include, in accordance with an aspect of the present disclosure, a condensate management system configured to manage condensate, namely, condensate generated along a heat exchange coil of an HVAC system. The condensate management system, in accordance with present embodiments, includes an ultrasonic transducer configured to atomize fluid particles of the condensate, and a solid desiccant configured to absorb the atomized fluid particles of the condensate.

The solid desiccant may also be configured to subcool refrigerant prior to the refrigerant entering the heat exchange coil. That is, a conduit carrying the refrigerant to the heat exchange coil may pass through, or abut, the solid desiccant. The atomized fluid particles absorbed by the solid desiccant may reduce a temperature of the solid desiccant, such that the solid desiccant includes a temperature suitable for subcooling the refrigerant passing through the above-described conduit. These and other features will be described in detail below.

Figure 5:
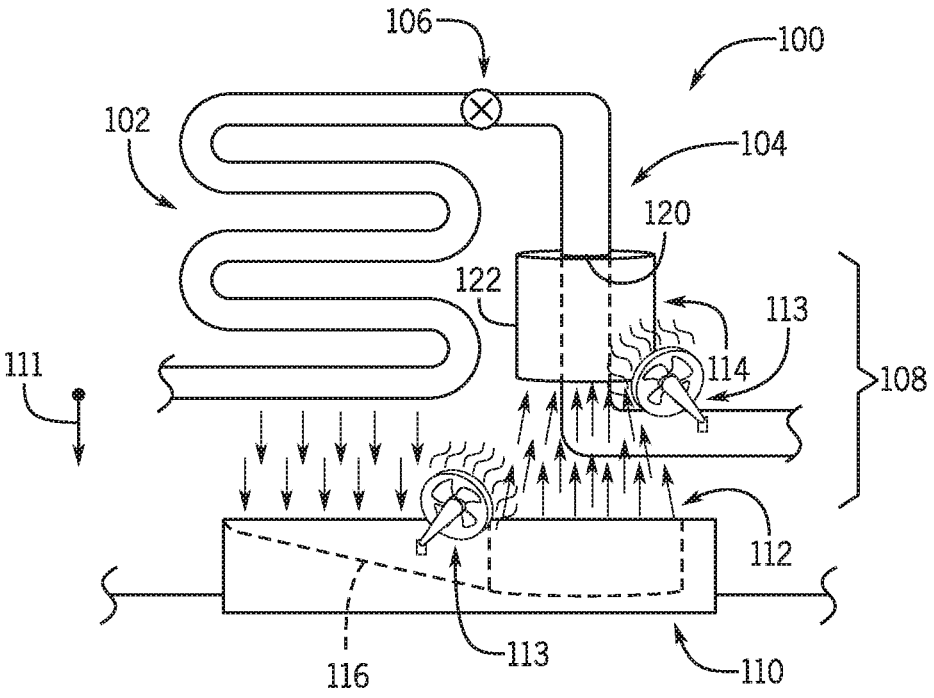
FIG. 5 is a schematic diagram illustrating an embodiment of a fluid handling system having portions of an HVAC system and a condensate management system, in accordance with embodiments described herein.

FIG. 5 is schematic diagram illustrating an embodiment of a fluid handling system 100 having portions of an HVAC system and a fluid condensate management system. In the illustrated embodiment, the fluid handling system 100 includes a heat exchange coil 102 of an HVAC system, such as an evaporator coil. The fluid handling system 100 also includes a fluid conduit, or "refrigerant conduit 104," positioned upstream of the heat exchange coil 102 and configured to supply the refrigerant to the heat exchange coil 102. An expansion device 106 may be positioned along the refrigerant conduit 104, along the heat exchange coil 102, or between the refrigerant conduit 104 and the heat exchange coil 102. As previously described, the expansion device 106 may be configured to expand the liquid refrigerant prior to delivery of the refrigerant to the heat exchange coil 102. A fan (not shown) of the HVAC portion of the fluid handling system 100 may urge an air flow over the heat exchange coil 102, such that heat is extracted from the air by the refrigerant passing through the heat exchange coil 102. As the air passes over an exterior of the heat exchange coil 102, the air is cooled, which may cause fluid condensate to form along the exterior of the heat exchange coil 102.

The fluid handling system 100 also includes a condensate management system 108, as described above. For example, the fluid handling system 100, in particular HVAC components of the fluid handling system 100, may generate fluid condensate. As previously described, the fluid condensate may be generated on an exterior of the heat exchange coil 102. In the illustrated embodiment, the condensate management system 108 includes a drain pan 110, an ultrasonic transducer 112, and a solid desiccant 114. The drain pan 110 is generally configured to receive the fluid condensate formed on the exterior of the heat exchange coil 102 as it accumulates and flows down as a result of gravity. For example, as shown, the drain pan 110 may be positioned underneath the heat exchange coil 102, with respect to a Gravity vector 111, such that the fluid condensate is gravity-fed into the drain pan 110.

Further, as shown, the ultrasonic transducer 112 may be positioned within the drain pan 110, such that the fluid condensate within the drain pan 110 is accessible by the ultrasonic transducer 112. In other embodiments, the ultrasonic transducer 112 may be positioned adjacent to and/or outside of the drain pan 110. In still other embodiments, the drain pan 110 may be, or include integrally formed therewith, the ultrasonic transducer 112. In general, the ultrasonic transducer 112 is positioned relative to the drain pan 110, and fluid condensate therein, such that the ultrasonic transducer 112 is capable of atomizing the fluid condensate to generate the atomized fluid particles. In the illustrated embodiment, the drain pan 110 includes a sloped internal surface 116, which slopes downwardly toward the ultrasonic transducer 112. Thus, the sloped internal surface 116 may route the fluid condensate toward the ultrasonic transducer 112 for atomization. However, in other embodiments, the internal surface of the drain pan 110 may be flat.

To generate the atomized fluid particles, the ultrasonic transducer 112 may impart vibrations, or "ultrasonic activity," to the condensate, which may cause capillary waves across the condensate. As the vibrations increase and the capillary waves increase in height, the waves may become too tall too support themselves. Droplets of the condensate may separate from the tips of the waves as the droplets overcome the surface tension across the condensate. The separated droplets may be referred to as "atomized fluid particles." In some embodiments, the ultrasonic transducer 112 may be a piezoelectric ultrasonic transducer, which includes a material that rapidly expands and contracts when voltage is applied thereto, causing a diaphragm coupled to the material to vibrate, imparting the above-described ultrasonic activity. However, other ultrasonic transducers 112 are also possible in accordance with the present disclosure.

The condensate management system 108, as noted above, also includes the solid desiccant 114. In general, the solid desiccant 114 is positioned and configured to receive the atomized fluid particles. In the illustrated embodiment, the solid desiccant 114 is positioned above the ultrasonic transducer 112, with respect to the Gravity vector 111, such that the rising atomized fluid vapor particles are absorbed by the solid desiccant 114. The solid desiccant 114 may be positioned immediately above the drain pan 110 in order to receive the atomized particles as they are formed. For example, the ultrasonic activity may cause capillary waves in the condensate, which increase in height toward the solid desiccant 114, and the atomized fluid particles may separate from the waves immediately adjacent the solid desiccant 114, such that the atomized fluid particles are absorbed by the solid desiccant 114. In certain embodiments, one or more fans 113 may blow air across the flow of atomized fluid particles and toward the solid desiccant 114, to assist movement of the atomized fluid particles toward and into the solid desiccant 114. The solid desiccant 114 may then absorb the atomized fluid particles therein. The one or more fans 113 may also blow air against the solid desiccant 114 in order to distribute the atomized fluid particles within the solid desiccant 114, thereby utilizing the surface area of the solid desiccant 114 more effectively. Each of the one or more fans 113 may be selectively positioned to enable the above-described effects. Thus, the condensate management system 108 manages the condensate without utilizing an external drain, and without discarding condensate to a surrounding environment, such as a building roof. In doing so, maintenance time and costs of the fluid handling system 100 may be reduced over embodiments utilizing an external drain.

In addition to the features noted above, the refrigerant conduit 104 of the fluid handling system 100 is configured to abut the solid desiccant 114. In the illustrated embodiment, the refrigerant conduit 104 passes through the solid desiccant 114. As the refrigerant passing through the refrigerant conduit 104 is routed adjacent to, or within, the solid desiccant 114, the solid desiccant 114 may extract heat from the refrigerant, thereby subcooling the refrigerant. As shown, the refrigerant conduit 104 may pass directly through an opening 120 in the solid desiccant. In other embodiments, the refrigerant conduit 104 may abut an edge 122 of the solid desiccant 114. It should be noted that the cylindrical shape of the solid desiccant 114 in the illustrated embodiment is non-limiting, and provided merely as an example. Similarly, the ultrasonic transducer 112 is illustrated as having a cylindrical shape, although other shapes in accordance with the present disclosure are also possible.

Figure 6:
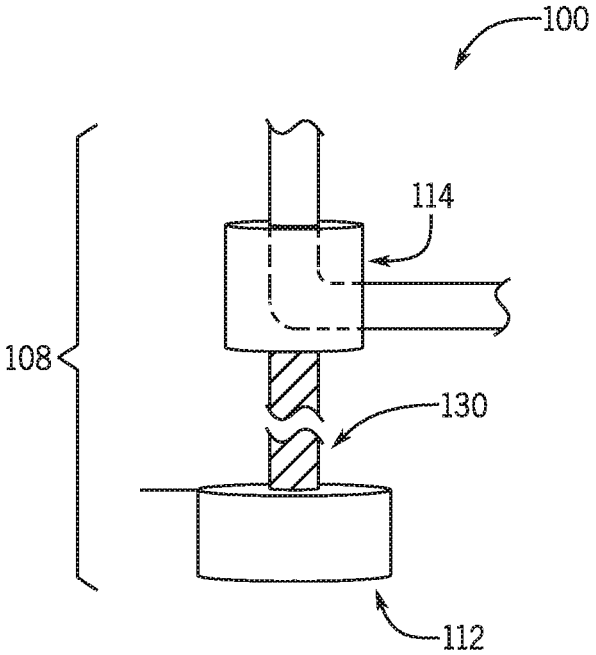
FIG. 6 is a schematic diagram illustrating an embodiment of a fluid handling system having portions of an HVAC system and a condensate management system, in accordance with embodiments described herein.

FIG. 6 is a schematic diagram illustrating an embodiment of the fluid handling system 100. For example, the illustrated fluid handling system 100 includes certain components of the aforementioned condensate management system 108. In the illustrated embodiment, the condensate management system 108 includes a vapor guide or conduit 130 extending between the ultrasonic transducer 112 and the solid desiccant 114. The vapor conduit 130 may be configured to convey the atomized fluid particles from the ultrasonic transducer 112, or from a drain pan associated with the ultrasonic transducer 112, to the solid desiccant 114. For example, the vapor conduit 130 may be a tube with a substantially constant cross-section, or the vapor conduit 130 may be a funnel with an increasingly smaller cross-section as the funnel approaches the solid desiccant 114. In some embodiments, the vapor conduit 130 may include an outlet positioned underneath, but not structurally coupled to, the solid desiccant 114. In other embodiments, the vapor conduit 130 may directly abut the solid desiccant 114. In general, the vapor conduit 130 may contain the atomized fluid particles and direct the atomized fluid particles into the solid desiccant 114. However, as shown in FIG. 5 and FIG. 7, certain embodiments may not include the vapor conduit 130, and the atomized fluid particles may instead travel between the ultrasonic transducer 112 and the solid desiccant 114 without the assistance of a conduit.

Further, in certain embodiments, the solid desiccant 114 may be positioned in a different area of the fluid handling system 100 than described above with respect to FIG. 5, and the vapor conduit 130 may carry the atomized fluid particles to the solid desiccant 114 located in the different area. Thus, the cooling by the solid desiccant 114, which is enabled at least in part via the fluid particles absorbed by the solid desiccant 114, may be utilized in other areas of the fluid handling system 100 and/or HVAC system thereof.

Figure 7:
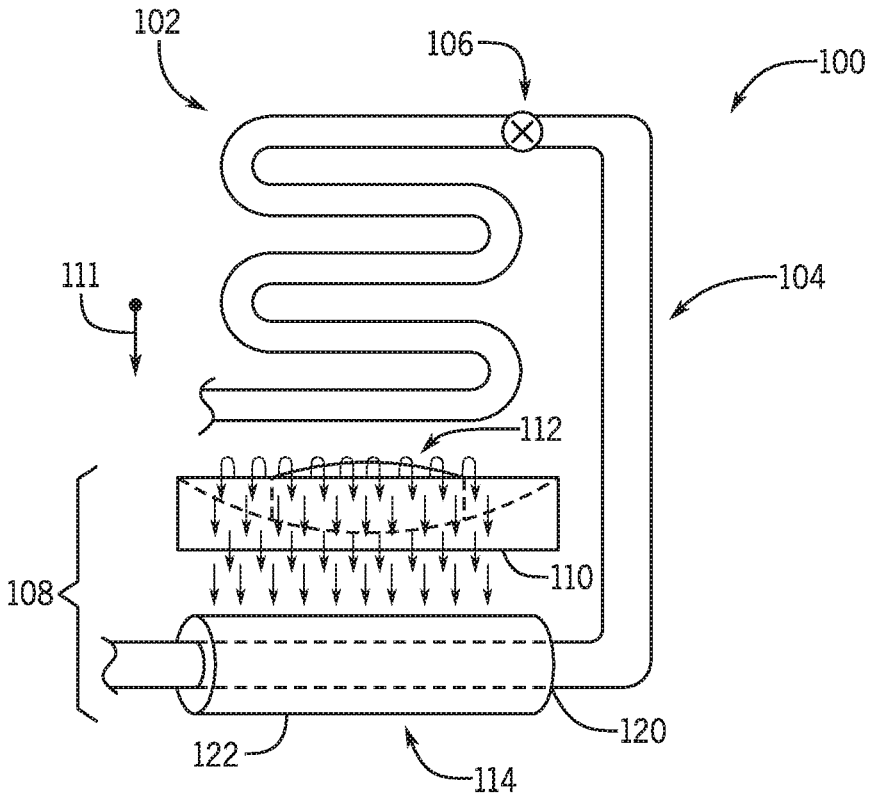
FIG. 7 is a schematic diagram illustrating an embodiment of a fluid handling system having portions of an HVAC system and a condensate management system, in accordance with embodiments described herein.

FIG. 7 is schematic diagram illustrating an embodiment of the fluid handling system 100 having portions of an HVAC system and the fluid condensate management system 108. In the illustrated embodiment, the fluid condensate management system 108 includes the drain pan 110, the ultrasonic transducer 112, and the solid desiccant 114.

The solid desiccant 114 in the illustrated embodiment is disposed underneath the drain pain 110. As previously described, the ultrasonic transducer 112 may cause vibrations within a volume of condensate captured by the drain pan 110. The vibrations may cause capillary waves in the volume of condensate, and when an amplitude of the capillary waves reaches a critical height, atomized fluid particles may fall off the tips of the waves as the waves are unable to support themselves. In some embodiments, the atomized fluid particles may be gravity-fed downwardly and out of the drain pan 110. The solid desiccant 114 below the drain pan 110 may receive the droplets, as previously described, which may lower a temperature of the solid desiccant 114. The absorption of the atomized fluid particles by the solid desiccant 114 may facilitate subcooling of refrigerant flowing in a refrigerant line 104, which abuts or passes through the solid desiccant 114, as described above.

Figure 8:
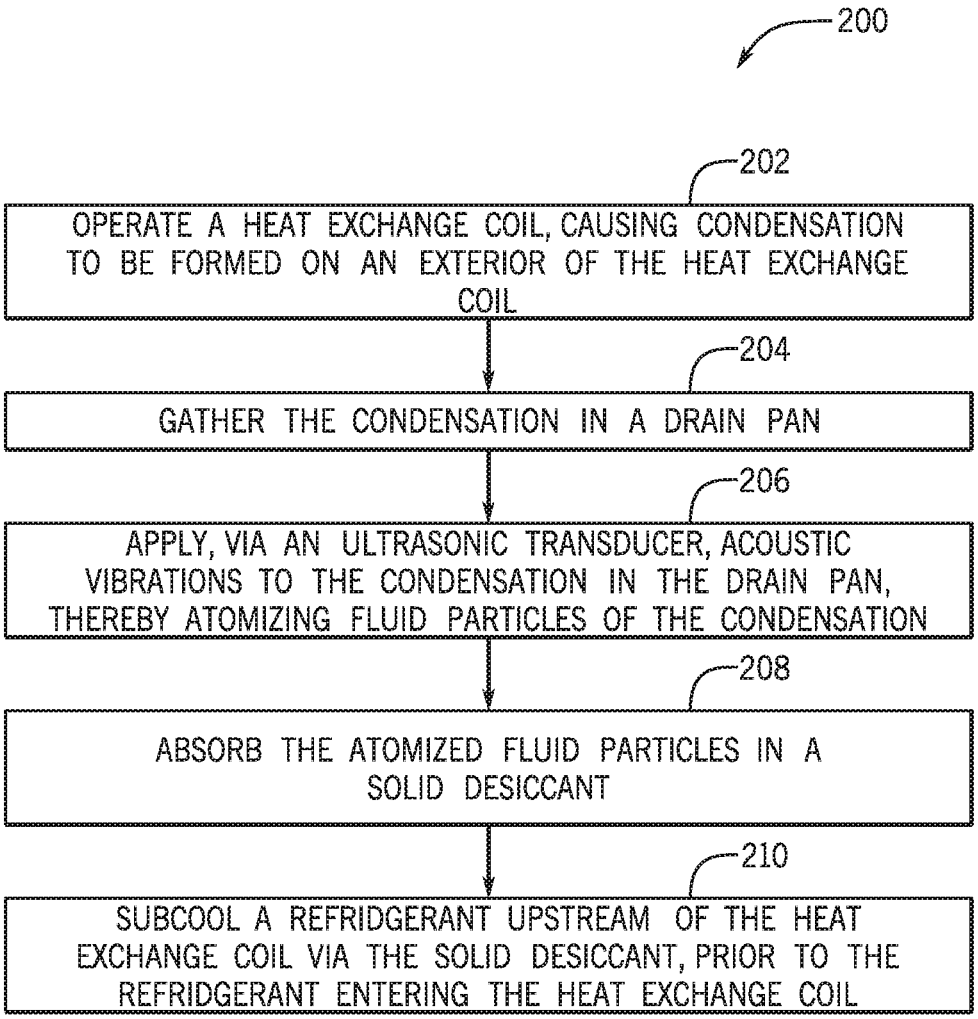
FIG. 8 is a flow diagram illustrating an embodiment of a method of managing condensate generated by an HVAC system, in accordance with embodiments described herein.

FIG. 8 is a flow diagram illustrating an embodiment of a method 200 of managing condensate generated by a fluid handling system, such as by an HVAC system of the fluid handling system. In the illustrated embodiment, the method 200 includes operating (block 202) a heat exchange coil, which causes liquid condensation to be formed on an exterior of the heat exchange coil. For example, as previously described, refrigerant may be routed through the heat exchange coil, and a fan may blow air over the heat exchange coil. As the refrigerant extracts energy from the air, the air may cool, causing vapor particles to become liquid particles. The liquid particles, referred to as condensate, may gather on an exterior of the heat exchange coil.

The method 200 also includes gathering (block 204) the condensate. For example, as previously described, the condensate may be gravity-fed into a drain pan underneath the heat exchange coil. The method 200 also includes applying (block 206) acoustic vibrations via an ultrasonic transducer. The ultrasonic transducer may be positioned or, or adjacent to, the drain pan. In general, the ultrasonic transducer is positioned and configured such that the ultrasonic transducer is capable of applying the acoustic vibrations to the condensate in the drain pan. By applying the acoustic vibrations, the ultrasonic transducer may atomize fluid particles of the condensate.

The method 200 also includes absorbing (block 208) the atomized fluid particles in a solid desiccant. As noted above, the atomized fluid particles may rise, for example via assistance of a fan and/or guide conduit, toward the solid desiccant, which may be positioned above the drain pan and/or ultrasonic transducer. Alternatively, the atomized fluid particles may fall toward the solid desiccant, which may be positioned beneath the drain pan and/or ultrasonic transducer.

The method 200 also includes subcooling (block 210) refrigerant via the solid desiccant. For example, a temperature of the solid desiccant may be reduced by the absorbed atomized fluid particles. A refrigerant conduit which feeds the refrigerant to the heat exchange coil may pass through, or abut, the solid desiccant, such that the solid desiccant subcools a refrigerant passing through the refrigerant conduit. Accordingly, not only is the condensate managed via the ultrasonic transducer and solid desiccant, the condensate is recycled in order to subcool the refrigerant prior to the refrigerant passing through an expansion valve and entering the heat exchange coil, which improves an efficiency of the heat exchange coil and corresponding refrigerant.

Technical benefits of embodiments of the present disclosure include improved management of condensate, which reduces required maintenance, and improved efficiency of a heat exchange coil. For example, instead of draining condensate in accordance with traditional embodiments, the presently disclosed condensate management system atomizes the condensate and absorbs the atomized fluid particles, where the absorbed fluid particles are utilized to subcool a refrigerant upstream of the heat exchange coil. Thus, drain maintenance is negated, and an efficiency of the system is improved.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fluid handling system, comprising:

an ultrasonic transducer configured to atomize fluid condensate generated by the fluid handling system into atomized fluid particles;

a solid desiccant configured to absorb the atomized fluid particles; and a fluid conduit extending through or in contact with the solid desiccant such that the solid desiccant is configured to cool a heat exchange fluid passing along the fluid conduit.

2. The fluid handling system of claim 1, comprising a heating, ventilation, and air conditioning (HVAC) system having the fluid conduit, wherein the fluid conduit is fluidly coupled to a heat exchange coil of the HVAC system such that the heat exchange coil is configured to receive the heat exchange fluid from the fluid conduit.

3. The fluid handling system of claim 1, wherein the ultrasonic transducer comprises a piezoelectric ultrasonic transducer.

4. The fluid handling system of claim 1, comprising a heat exchange coil and a fan, wherein the heat exchange coil is configured to receive the heat exchange fluid, wherein the fan is configured to urge an air flow over an exterior of the heat exchange coil, and wherein the fluid condensate is generated from the air flow and on the exterior of the heat exchange coil.

5. The fluid handling system of claim 1, comprising:

a heat exchange coil having an exterior on which the fluid condensate is formed; and a drain pan positioned, with respect to Gravity, underneath the heat exchange coil, such that the fluid condensate is gravity-fed from the exterior of the heat exchange coil into the drain pan.

6. The fluid handling system of claim 1, comprising a drain pan configured to receive the fluid condensate, wherein the ultrasonic transducer is positioned relative to the drain pan such that vibrations of the ultrasonic transducer atomize the fluid condensate to generate the atomized fluid particles.

7. The fluid handling system of claim 6, wherein the drain pan comprises a sloped internal surface configured to receive the fluid condensate, wherein the sloped internal surface slopes downwardly, with respect to Gravity, toward the ultrasonic transducer.

8. The fluid handling system of claim 1, comprising a vapor conduit extending between the ultrasonic transducer and the solid desiccant, wherein the vapor conduit is configured to route the atomized fluid particles from the ultrasonic transducer toward the solid desiccant.

9. The fluid handling system of claim 1, comprising:

a heat exchange coil configured to receive the heat exchange fluid from the fluid conduit; and an expansion valve positioned along the fluid conduit upstream of the heat exchange coil.

10. The fluid handling system of claim 1, comprising a fan configured to urge the atomized fluid particles toward the solid desiccant.

11. The fluid handling system of claim 1, wherein the solid desiccant is positioned beneath the ultrasonic transducer.

12. The fluid handling system of claim 1, comprising a heat exchange coil configured to receive the heat exchange fluid through an interior of the heat exchange coil and configured to receive an air flow over an exterior of the heat exchange coil, wherein the fluid conduit is positioned upstream of the heat exchange coil.

13. The fluid handling system of claim 12, comprising an expansion valve positioned between the heat exchange coil and the fluid conduit.

14. The fluid handling system of claim 12, comprising an expansion valve positioned between the heat exchange coil and the solid desiccant.

15. A fluid handling system, comprising:

a heat exchange coil configured to receive a refrigerant;

a drain pan configured to receive fluid condensate formed on an exterior of the heat exchange coil;

an ultrasonic transducer configured to atomize the fluid condensate into atomized fluid particles;

a solid desiccant configured to absorb the atomized fluid particles; and a refrigerant conduit fluidly coupled to the heat exchange coil and configured to provide the refrigerant to the heat exchange coil, wherein the refrigerant conduit extends through or in contact with the solid desiccant such that the solid desiccant is configured to cool the refrigerant passing through the refrigerant conduit.

16. The fluid handling system of claim 15, comprising a fan configured to urge an air flow over the heat exchange coil, wherein the fluid condensate is generated from the air flow.

17. The fluid handling system of claim 15, wherein the ultrasonic transducer comprises a piezoelectric ultrasonic transducer.

18. The fluid handling system of claim 15, comprising the drain pan positioned, with respect to Gravity, underneath the heat exchange coil, such that the fluid condensate is gravity-fed from the exterior of the heat exchange coil into the drain pan.

19. The fluid handling system of claim 18, wherein the drain pan comprises a sloped internal surface configured to receive the fluid condensate, wherein the sloped internal surface slopes downwardly toward the ultrasonic transducer.

20. The fluid handling system of claim 15, comprising a vapor conduit extending between the ultrasonic transducer and the solid desiccant, wherein the vapor conduit is configured to route the atomized fluid particles from the ultrasonic transducer toward the solid desiccant.

21. A fluid handling system, comprising:

a heating, ventilation, and air conditioning (HVAC) system, wherein the HVAC system comprises a heat exchange coil, a refrigerant conduit configured to supply a refrigerant to the heat exchange coil, and a fan configured to urge an air flow over the heat exchange coil as the refrigerant passes through the heat exchange coil; and a fluid condensate management system, wherein the fluid condensate management system comprises an ultrasonic transducer configured to atomize fluid condensate generated on the heat exchange coil into atomized fluid particles, wherein the fluid condensate management system comprises a solid desiccant configured to absorb the atomized fluid particles, and wherein the refrigerant conduit of the HVAC system is configured to extends through or in contact with the solid desiccant of the fluid condensate management system such that the solid desiccant is configured to cool the refrigerant passing through the refrigerant conduit.

22. The fluid handling system of claim 21, comprising a drain pan configured to receive the fluid condensate, wherein the ultrasonic transducer is positioned relative to the drain pan such that vibrations of the ultrasonic transducer atomize the fluid condensate within the drain pan to generate the atomized fluid particles.

23. The fluid handling system of claim 21, wherein the ultrasonic transducer comprises a piezoelectric ultrasonic transducer.

24. The fluid handling system of claim 21, comprising a vapor conduit extending between the ultrasonic transducer and the solid desiccant, wherein the vapor conduit is configured to route the atomized fluid particles from the ultrasonic transducer toward the solid desiccant.

* * * * *